United States Patent [19]

Yamagami et al.

[11] Patent Number: 4,462,059

[45] Date of Patent: Jul. 24, 1984

[54] DEMAGNETIZING POWER SOURCE

[75] Inventors: Kikuo Yamagami; Koji Yokoyama, both of Nagano, Japan

[73] Assignee: Kanetsu Kogyo Kabushiki Kaisha, Ueda, Japan

[21] Appl. No.: 309,375

[22] Filed: Oct. 7, 1981

[30] Foreign Application Priority Data

Oct. 27, 1980 [JP] Japan ..... 55-149323

[51] Int. Cl.[3] ..... H01F 13/00

[52] U.S. Cl. ..... 361/149; 361/267

[58] Field of Search ..... 361/149, 145, 267, 144; 335/284, 289, 290; 360/66, 118; 209/8; 364/478

[56] References Cited

U.S. PATENT DOCUMENTS 3,164,753 1/1965 Schroeder ..... 361/149 X 4,195,346 3/1980 Schröder ..... 364/478 X

*Primary Examiner*—Reinhard J. Eisenzopf

*Attorney, Agent, or Firm*—Kane, Dalsimer, Kane, Sullivan and Kurucz

[57] ABSTRACT

A demagnetizing power source for producing an attenuation alternating field to demagnetize a magnetized substance. This power source is provided with a memory circuit for sending actuating signals to a polarity changing-over circuit to change over the polarity of direct current supplied from a rectifying circuit to an exciting coil. In the memory circuit are stored a plurality of preset demagnetizing patterns. The polarity changing-over circuit changes over alternatively the polarity and gradually decreases the change-over cycle according to the selected demagnetizing pattern.

7 Claims, 3 Drawing Figures

DEMAGNETIZING POWER SOURCE

BACKGROUND OF THE INVENTION

1. Field of the Invention

This invention relates to a demagnetizing power source used for demagnetizing a magnetized substance by a loop damping demagnetization technique.

2. Description of the Prior Art

In known demagnetizing power source of the foregoing type, the constant voltage direct current output of a rectifying circuit is supplied to an exciting coil through a polarity changing-over circuit having a pair of relays. Operation of this polarity changing-over circuit was conventionally controlled by a limit switch for controlling the energization of these relays and a rotary cam for controlling the turning-on/off of the limit switch or by a switch mechanism consisting of a rotary disk having a conductive strips attached and divided circumferentially and a brush making contact with the rotary disk. Prior art disclosing use of a rotary disk is typified by U.S. Pat. No. 3,164,753.

However, the control of the change-over cycle by the rotor of the rotary cam or rotary disk type can not change over the polarity of current supplied to the exciting coil with high speed and thus a satisfactory demagnetizing effect cannot be obtained. Also with such prior power sources, pattern of change-over cycle is determined by the rotary cam or rotary disk each formed with conductive strips; and, consequently dispersion occurs due to the accuracy of finishing said rotary cam or rotary disk, thereto resulting in dispersion of the demagnetizing effect. Further, in order to change the change-over cycle to have high demagnetizing effect in such prior power sources, the rotary cam or rotary disk needs to be replaced so that the pattern of change-over cycle is not easily accomplished.

SUMMARY OF THE INVENTION

An object of the present invention is to eliminate defects of the aforementioned prior art by providing a demagnetizing power source capable of selecting a plurality of patterns of change-over cycles without requiring replacement of parts.

According to the present invention, demagnetizing power source is provided for supplying to an exciting coil the output direct current of a rectifying circuit with its polarity alternatively changed over by a polarity changing-over circuit; and its change-over cycle gradually reduced to produce a damping alternate field for demagnetization in the exciting coil. The power source is characterized by a plurality of patterns of change-over cycles, with demagnetizing patterns being stored in a memory circuit and selected to enable a desired change-over cycle to control the polarity changing-over circuit so that a uniform high demagnetizing effect can be obtained without replacement of parts.

BRIEF DESCRIPTION OF THE INVENTION

DESCRIPTION OF THE PREFERRED EMBODIMENTS

Figure 1:
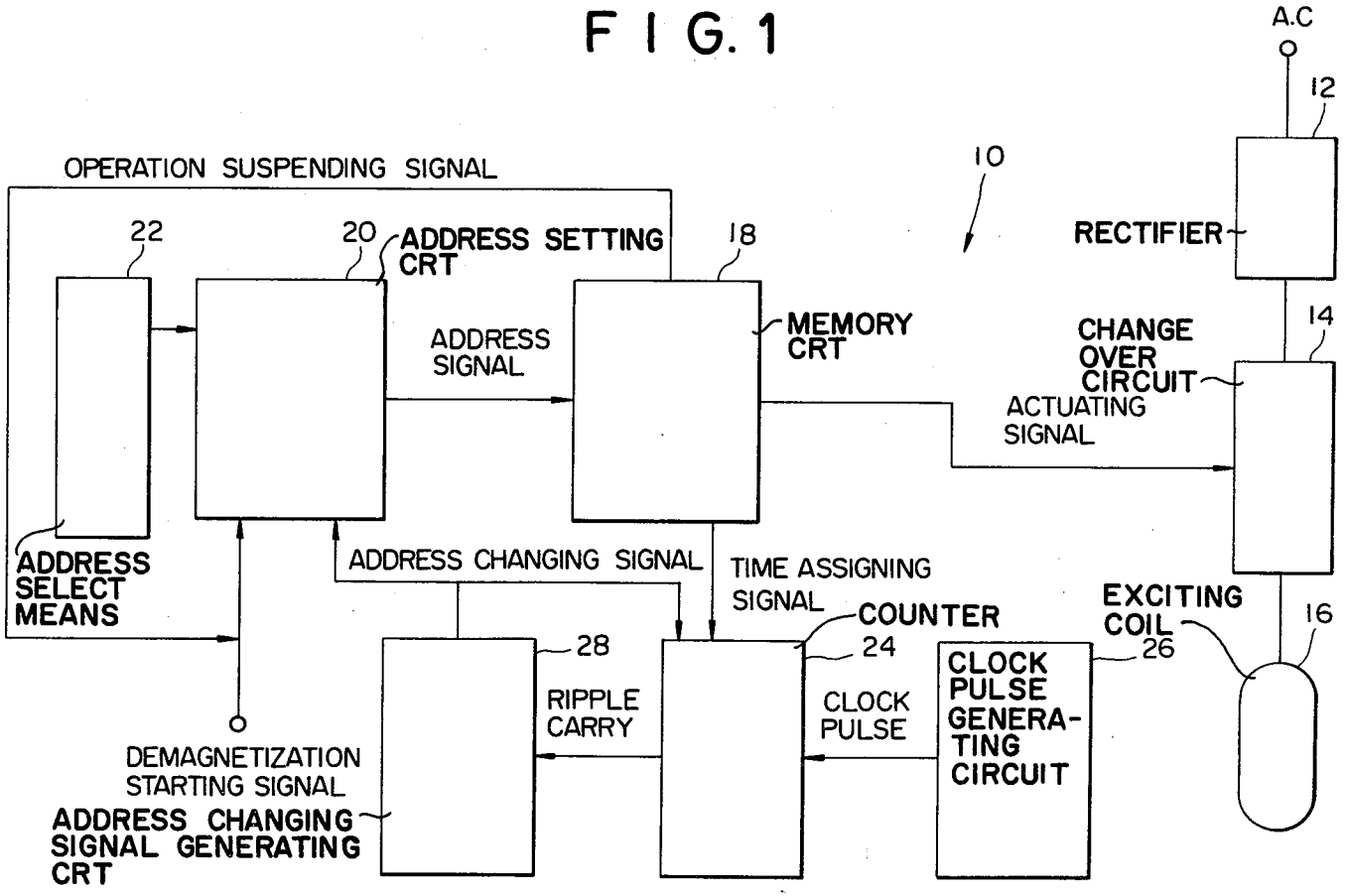
FIG. 1 is a diagramatic view showing a demagnetizing power source according to the present invention.

Other objects and advantages will become apparant from the following detailed description of embodiments shown in the drawings.

In FIG. 1 a demagnetizing power source 10 comprises a rectifying circuit 12 for rectifying alternate current AC and a polarity changing-over circuit 14 for changing over the polarity of the direct current output with a constant voltage of the rectifying circuit. The direct current having the polarity changed over alternatively by the polarity changing-over circuit is supplied to an exciting coil 16 of an electromagnetic chuck, for example.

The changing-over circuit 14 is controlled by the output actuating signal of a memory circuit 18 in which is stored information for a plurality of demagnetizing patterns determining gradually decreasing ratio of energizing times of an energizing coil 16 in one direction and the opposite one sandwiching a quiescent time of current supply to the energizing coil 16. Obviously, the quiescent time of current supply can be dispensed with.

The memory circuit 18 receives address signals from an address setting circuit 20 which sends an initial address signal assigned by an initial address selecting means 22 for selecting the demagnetizing pattern to the memory circuit 18 according to the input of demagnetization starting signal. The memory circuit 18 sends the actuating signal to the polarity changing-over circuit 14 while sending the time assigning signal of said address to a counter circuit 24.

The counter circuit 24 receives clock pulses from a clock pulse generating circuit 26. When the number of the clock pulses reaches a numerical value specified by said time assigning signal from the memory circuit 18, the counter circuit 24 sends a ripple carry to an address changing signal generating circuit 28. When said circuit 28 receives the ripple carry, it sends the address changing signals, respectively, to said address setting circuit 20 and the counter circuit 24.

Upon receiving this address changing signal, the address setting circuit 20 sends the address signal to said memory circuit 18 to perform one selected demagnetizing pattern. The memory circuit 18 receives this address signal and sends the actuating signal of a new address following said address corresponding to said initial address signal to the polarity changing-over circuit 14 while sending the time assigning signal of said new address to the counter circuit 24. This counter circuit 24 sends the ripple carry to said circuit 28 in the same way as above mentioned when the number of said clock pulses reaches a numerical value specified by a new time assigning signal.

As a result of the repetition of operations of said circuits the polarity changing-over circuit 14 is operated to gradually reduce the change-over cycle of positive and negative direct currents to the exciting coil 16 along one demagnetizing pattern stored and selected in the memory circuit 18, interposing the quiescent time of current supply to said exciting coil between said both currents. Said memory circuit 18 sends the operation suspending signal to the address setting circuit 20 and the energization of said exciting coil 16 is cut off when the address corresponding to the address signal received from the address setting circuit 20 reaches the termination of the demagnetizing pattern.

Figure 2:
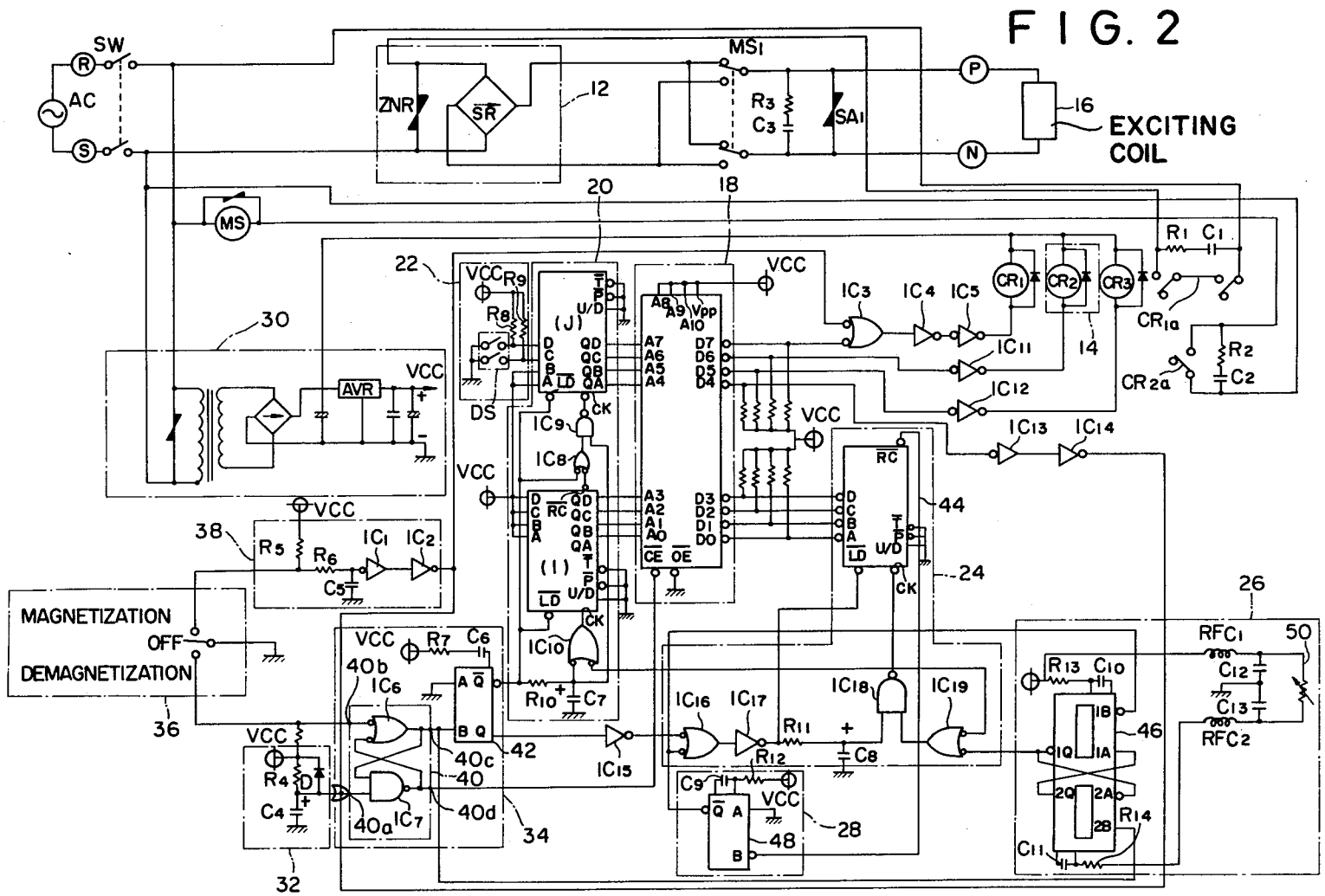
FIG. 2 is an electric circuit diagram of a demagnetizing device according to the present invention.

FIG. 2 shows demagnetizing power source circuit 10 according to the present invention, in which is incorporated a circuit for supplying a constant voltage direct current power source to the exciting doil 16 of said electromagnetic chuck so as to permit the adsorption of a magnetic substance by means of the electromagnetic chuck. A rectifying circuit 12 is connected to the alternative current power source AC through a pair of power switches SW. The rectifying circuit 12 is provided with a rectifying element SR between the input terminals of which is provided a surge absorbing baristor ZNR. Also, between one of said power switches SW and the input terminal of the rectifying circuit 12 is inserted an a contact $CR_{1a}$ of an alternative current shutting-off relay $CR_1$ to which is connected surge absorbing element $R_1$,$C_1$.

In the output side of said rectifying circuit 12 are inserted contacts $Ms_1$ of a relay Ms constituting the polarity changing-over circuit 14. In the example shown in the drawing, the relay Ms is an auxiliary relay Ms operated by closing a a contact $CR_{2a}$ of a main relay $CR_2$ to which are connected surge absorbing elements $R_2$,$C_2$. The auxiliary relay Ms can be omitted by making the a contact $CR_{2a}$ of the main relay $CR_2$ the a contact $M_{s1}$. Between said polarity changing-over circuit 14 and exciting coil 16 are surge absorbing elements $R_3$,$C_3$,$SA_1$.

Furthermore, a well-known constant voltage power circuit 30 is connected to said alternative current power source AC through said pair of power switches SW. The constant voltage power circuit 30 supplies a predetermined actuating currents to respective circuits including said relays $CR_1$,$CR_2$, memory circuit 18, address setting circuit 20, initial address selecting means 22, counter circuit 24, clock pulse generating circuit 26 and address changing signal generating circuit 28.

An initiation setting circuit 32, one of the circuits having actuating current supplied from said constant voltage power circuit 30, is provided with a pull-up resistance $R_4$, diode D and capacitor $C_4$. Terminal voltage across the capacitor $C_4$ a predetermined time after turning on said power switch SW changes from "L" level to "H" one and this causes "H" level signal, i.e., "1" signal to be sent to the signal generating circuit 34 to initiate the whole unit.

This signal generating circuit 34 receives "0" signal as demagnetization starting signal from a control switch 36 through the change-over operation thereof. Also, the control switch 36 sends "0" signal to a positive excitation signal generating circuit 38 through its change-over operation to hold the adsorption of the magnetic substance with said chuck. Preferably, this control switch 36 is held mechanically in the positive excitation position by its operation from the neutral position to the positive excitation one, and, in the operation of this switch 36 to the demagnetization position return, returns automatically from the demagnetization position to the neutral one.

Said signal generating circuit 38 is provided with a pull-up resistance $R_5$, retardation elements $R_6$,$C_5$, wave-form forming NOT gate element $IC_1$ and NOT gate element $IC_2$. Said signal generating circuit 38, upon receiving "0" signal from said control switch 36 through the operation thereof, sends quiescence signal, i.e. "0" signal from the output terminal of the gate element $IC_2$ to said signal generating circuit 34 while sending "0" signal to NAND gate element (shown by NOR gate element symbol of negative logic in the drawing) $IC_3$. Said gate element $IC_3$, upon receiving said "0" signal, drives said relay $CR_1$ through NOT gate element $IC_4$ and driving element $IC_5$. But said drive relay $CR_2$ is not driven, and the contact $M_{s1}$ of the auxiliary relay is held in one closed position.

Accordingly, by operating said control switch 36 to the positive excitation position after the switch SW is turned on, relay $CR_1$ is driven, and, in this manner, a constant voltage direct current can be supplied to the exciting coil 16 of said chuck to cause said chuck to produce a constant magnetic field for holding the magnetic substance.

The signal generating circuit 34 receiving "0" signal through the operation of said control switch 36 to the demagnetization position is provided with a RS flip-flop 40 consisting of a pair of wave-form forming NAND gate elements $IC_6$,$IC_7$ ($IC_6$ is designated by NOR gate element symbol of negative logic) and a mono stable multiple vibrator 42. One input terminal 40*a* of the flip-flop 40 receives the output signals of said signal generating circuit 38 and initiation setting circuit 32 and the other input terminal 40*b* receives the output signal of the control switch 36. When the flip-flop 40 receives "1" signal at one input terminal 40*a* and "0" signal at the other input terminal 40*b*, it generates "1" signal from one output terminal 40*c* and "0" signal from the other output terminal 40*d*. These outputs are not changed unless the input signal of one input terminal 40*a* is "0" even if the input signal of the other input terminal 40*b* is changed to "1" signal, and said flip-flop 40 receives the quiescence signals, i.e. "0" signals of said positive excitation signal generating circuit 38 and memory circuit 18 at the input terminal 40*a* to reverse the output signal. Thus, when the flip-flop 40 receives "1" signal from the signal generating circuit 34 and the demagnetization starting signal, i.e. "0" signal from said control switch 36, it generates the output "1" signal from one output terminal 40*c* and the output "0" signal from the other output terminal 40*d*. These output conditions are self-held to prevent said switch 36 from chuttering.

When the vibrator 42 receives "1" signal from said flip-flop 40 at the input terminal B, it generates positive single pulse from its output terminal Q and negative single pulse from its output terminal $\overline{Q}$. The width of each single pulse is determined by each value of a resistance $R_7$ and capacitor $C_6$. The output "0" signal generated from the output terminal 40*d* of said flip-flop 40 is sent to the memory circuit 18, and the negative single pulse generated from the output terminal $\overline{Q}$ of said vibrator 42 is sent to the address setting circuit 20.

The address setting circuit 20 shown in the drawing, is provided with two up-down counters I,J connected in series with each other through NAND gate elements $IC_8$,$IC_9$ (the gate element $IC_8$ is shown by NOR symbol of negative logic) and having respectively four input terminals A–D and four output terminals $Q_A$–$Q_D$, pull-up resistances $R_8$,$R_9$ and two DIP switches DS constituting the initial address selecting means 22, a NAND gate element $IC_{10}$ (shown by NOR symbol of negative logic) and retardation elements $R_{10}$,$C_7$. The two up-down counters may be unified to one up-down counter.

Two input terminals C,D of said up-down counter J are respectively connected to DIP switches DS; and to the other input terminals A,B is applied constant voltage Vcc. Also, to the input terminals A–D of the up-down counter I is applied the constant voltage Vcc. Thus, by operating the two DIP switches DS four kinds of leading addresses in said address selecting circuit 20 can be selected. The output terminals $Q_A$–$Q_D$ of said up-down counter J are connected to the corresponding address buses $A_4$–$A_7$ in the memory circuit 18, and the output terminals $Q_A$–$Q_D$ of the up-down counter I are connected respectively to the corresponding address buses $A_0$–$A_3$ in the memory circuit 18. The respective output terminals of both up-down counters I,J,i.e. the respective output terminals $Q_A$–$Q_D$,$Q_A$–$Q_D$ of the address setting circuit 20 are preset to (1111,1111) and can have conditions up to (0000,0000).

Both up-down counters I,J receive said negative single pulse from the output terminal $\overline{Q}$ of said vibrator 42 at the respective $\overline{LD}$ terminals and receives the single pulse as the positive single pulse at the respective CK terminals, respectively, through said gate element $IC_9$ and gate element $IC_{10}$ with a predetermined time retardation due to said retardation elements $R_{10}$,$C_7$. Both counters I,J, upon receiving said single pulse at the respective $\overline{LD}$ and CK terminals, generate the output signals corresponding to signals set to the respective input terminals A–D, A–D to the respective output terminals $Q_A$–$Q_D$, $Q_A$–$Q_D$. Also, every time the up-down counter I receives address changing signal from the address changing signal generating circuit 28 through said gate element $IC_{10}$ at said CK terminal, it carries out the subtraction of the output (1111) from the output terminals $Q_A$–$Q_D$. When the output terminals $Q_A$–$Q_D$ of this up-down counter I become (0000), negative pulses are generated from $\overline{RC}$ terminal of the up-down counter for every successive input of said address changing signal and thus the up-down counter J performs subtraction of the output F(1111) from the output terminal $Q_A$–$Q_D$.

Thus, the address setting circuit 20, upon receiving the negative single pulse at said both $\overline{LD}$ terminals and "1" signal at CK terminal of the up-down counter I, sends the leading address signal selectively specified by said DIP switches DS from the output terminals $Q_A$–$Q_D$, $Q_A$–$Q_D$ to the respective corresponding address buses $A_0$–$A_7$ in the memory circuit 18, and upon receiving "1" signal only at CK terminal of the up-down counter I, sends a new address signal following said leading address to said address buses $A_0$–$A_7$ to carry out one of demagnetization patterns selected by said DIP switches DS.

The memory circuit 18 consisting of IC in the illustrated embodiment, is provided with eight address buses $A_0$–$A_7$ and eight data buses $D_0$–$D_7$ corresponding to said output terminals $Q_A$–$Q_D$, $Q_A$–$Q_D$ in the address setting circuit 20. The memory circuit 18, upon receiving "0" signal from the output terminal **40*d* of said flip-flop 40 at the $\overline{CE}$ terminal, read the address signal from said address setting circuit 20 through the address buses $A_0$–$A_7$ to send the output information corresponding to the address assigned by the address signal to the data buses $D_0$–$D_7$. To the memory circuit 18 is applied the input information of a plurality of demagnetization patterns, four patterns for example. From the data buses $D_5$–$D_7$ in the upper 3 bits are generated drive signals as the output "0" signal for the respective relay $CR_1$,$CR_2$ and relay $CR_3$. The drive signal of the data bus $D_5$ is applied to the input of said $IC_3$ to close a contact $CR_{1a}$ of said relay $CR_1$. The drive signal of the data bus $D_6$ is applied to the input of a driving element $IC_{11}$ to change over contact $Ms_1$ of the auxiliary relay Ms, and the reduction of output terminal voltage of the element supplies direct current to the main relay $CR_2$ to energize the relay $CR_2$. The drive signal of the data bus $D_5$ is also applied to the input of a driving element $IC_{12}$ to thereby energize the relay $CR_3$. This relay $CR_3$ which may be dispensed with is a preparatory relay for operating apparatus added to the outside of said unit 10 in synchronization with the relay $CR_1$ of the polarity change-over circuit 14**.

The data bus $D_4$ of the memory circuit 18 generates a "0" signal as an operation stopping signal which is applied to said one input terminal **40*a* of the flip-flop 40 in said signal generating circuit 34 through NOT gate element $IC_3$ and open collector NOT gate element $IC_{14}$ to place the unit 10 in the quiescent condition. The output time data to the counter circuit 24 are generated from the data buses $D_0$–$D_3$ of the lower 4 bits in the memory circuit 18**.

The counter circuit 24 receiving the time data, i.e. time assigning signal from the data buses $D_0$–$D_3$ in the memory circuit 18 is provided with a counter 44 having input terminals A–D corresponding to the respective data buses $D_0$–$D_3$. The positive single pulse generated from the output terminal Q of said vibrator 42 passes through NOT gate element $IC_{15}$, NAND gate element $IC_{16}$ (shown by NOR symbol of negative logic) and NOT gate element $IC_{17}$ to be sent to $\overline{LD}$ terminal of said counter 44 as negative single pulse, and passes through NAND gate element $IC_{18}$ with a predetermined retardation time due to the retardation elements $R_{11}$,$C_8$ to be sent to CK terminal of said counter 44 as the positive single pulse. Said counter 44 receives said single pulse. Said counter 44 receives said single signal at the two LD and CK terminals and thus reads times $D_0$–$D_3$ from the memory circuit 18 at the input terminals A–D.

Also, the counter 44 receives clock pulse at the CK terminal from a clock pulse generating circuit 26 through NAND gate element $IC_{19}$ (shown by NOR symbol of negative logic) and said gate element $IC_{18}$, and sends the ripple carry of negative pulse from the $\overline{RC}$ terminal to the address changing signal generating circuit 28 when the number of the clock pulses reaches numerical value read from said input terminals A–D.

The output time assigning signals sent from the data buses $D_0$–$D_3$ of the lower 4 bits in said memory circuit 18 to the counter 44 are (0000)–(1111). For example, when the counter 44 reads the time assigning signal of (0010) corresponding to "2" in the decimal notation, the counter 44 sends the ripple carry to the address changing signal generating circuit 28 after it receives two clock pulses from the clock pulse generating circuit 26, i.e. after 2T, assuming the oscillation cycle of the clock pulse is T. Hence, time up to 15T can be set by the time information of the data buses $D_0$–$D_3$, and if longer time needs to be set, the time assigning signals $D_0$–$D_4$ of the lower 4 bits can be set to desired values to continue the signals of the data buses $D_4$–$D_7$ of the upper 4 bits irrespective of time setting in the succeeding addresses for compensating deficient time.

Said clock pulse generating circuit 26 is provided with a multiple vibrator 46. So long as the circuit 26 receives "1" signal at the input terminal 1B and "1" signal from the output terminal **40*c* of said flip-flop 40 at the input terminal 2B, it sends clock pulses from the output terminal 1Q to said CK terminal to the counter 44 through said gate elements $IC_{19}$,$IC_{18}$. Said oscillation cycle T of this clock pulse is determined by resistances $R_{13}$,$R_{14}$ and capacitors $C_{10}$,$C_{11}$, or can be varied between 0.01 and 0.1 sec., for example, by adding a variable resistor 50 to the multiple vibrator 48** through noise filters $RFC_1$,$RFC_2$,$C_{12}$,$C_{13}$, as shown in the drawing, and adjusting the variable resistor to increase or decrease the pulse interval.

Upon receiving "0" signal from the output terminal 40*c* of said flip-flop 40 at said input terminal 2B, said clock pulse generating circuit 26 stops the oscillation and, upon receiving address decrement signal of "0" signal from the address changing signal generating circuit 28 at said input terminal 1B, the oscillation stops temporarily.

Said address changing signal generating circuit 28 is provided with a mono stable multiple vibrator 48. The circuit 28, upon receiving said ripple carry from the counter 44 at the input terminal B, sends a negative pulse signal having a constant width determined by the resistance $R_{12}$ and capacitor $C_9$ as address changing signal, i.e. address decrement signal from the output terminal $\overline{Q}$ to said CK terminal of said up-down counter I through said gate element $IC_{10}$. As mentioned above, said address setting circuit 20 of this address decrement signal is operated by the input to send the succeeding output address signal to the memory circuit 18. The address decrement signal is sent to said LD terminal and CK terminal of the counter 44 through said gate elements $IC_{16}$,$IC_{17}$,$IC_{18}$. Thus the counter 44 reads a new succeeding output time assigning signal from said memory circuit 18. Further, this address decrement signal is sent to said input terminal 1B of the pulse generating circuit to stop temporarily the oscillation of said clock pulse generating circuit 26.

In the apparatus according to the present invention, "0" signal is given to said gate element $IC_3$ by operating said control switch 36 to the positive excitation position to thereby drive said relay $CR_1$ and energize the auxiliary relay Ms for permitting the a contact $CR_{1a}$ to be closed. Also, since the output "0" and "1" signals are sent respectively to the output terminals 40*c*,40*d* of said flip-flop 40 in said signal generating circuit 34, the oscillation of said clock pulse circuit 26 is stopped and the output "1" signal is generated from the data bus $D_6$ of said memory 18 so that the contact $Ms_1$ of the auxiliary relay Ms is held at one closed position. Hence, a constant direct current can be supplied to the exciting coil 16 of said chuck by operating said switch 36, so that a constant magnetic field can be produced in said chuck which can adsorbably hold magnetic substances.

In the removal of said magnetic substance from said chuck, a proper demagnetization pattern for erasing residual magnetism in the chuck is determined by operating said DIP switches DS of said initial address selecting means 22. Thereafter, the outputs of the output terminals 40*c*,40*d* of said flip-flop 40 can be respectively reversed by operating said control switch 36 to the demagnetization position. By this reversal of the output of the flip-flop 40, said address setting circuit 20 sends one output leading address assigning signal selected by said DIP switches DS to the memory circuit 18 which, for example, sends (1111), i.e. the output "F" signal indicated in sexadecimal notation to the data buses $D_7$–$D_4$, and (1111), i.e. the output "F" signal indicated by sexadecimal notation to the data buses $D_3$–$D_0$. Hence, for 15T seconds specified in the data buses $D_3$–$D_0$, said relays $CR_1$,$CR_2$,$CR_3$ are placed in the de-energized condition to stop the energization of said exciting coil.

When the number of clock pulses from said clock pulse generating circuit 26 reaches 15, i.e. after 15T seconds, the counter circuit 24 sends the ripple carry to said address changing signal generating circuit 28 which generates the address changing signal. According to this address changing signal, said address setting circuit 20 sends the output address assigning signal following said leading address signal, i.e. address assigning signal subtracted "1" from the leading address to the memory circuit. As a result, said memory circuit 18 sends (0011), i.e. the output "3" signal indicated in sexadecimal notation to the data buses $D_7$–$D_4$ for example, and (1111), i.e. the output "F" signal indicated in sexadecimal notation to the data buses $D_3$–$D_0$. Thus said relays $CR_1$ and $CR_2$ are energized. The energization of said relay $CR_1$ closes the relay contact $CR_{1a}$ and the energization of said relay $CR_2$ causes the contact $Ms_1$ of said relay Ms to be held in the other closed position. Thus, for 15T seconds, reverse current flows through the exciting coil 16.

Figure 3:
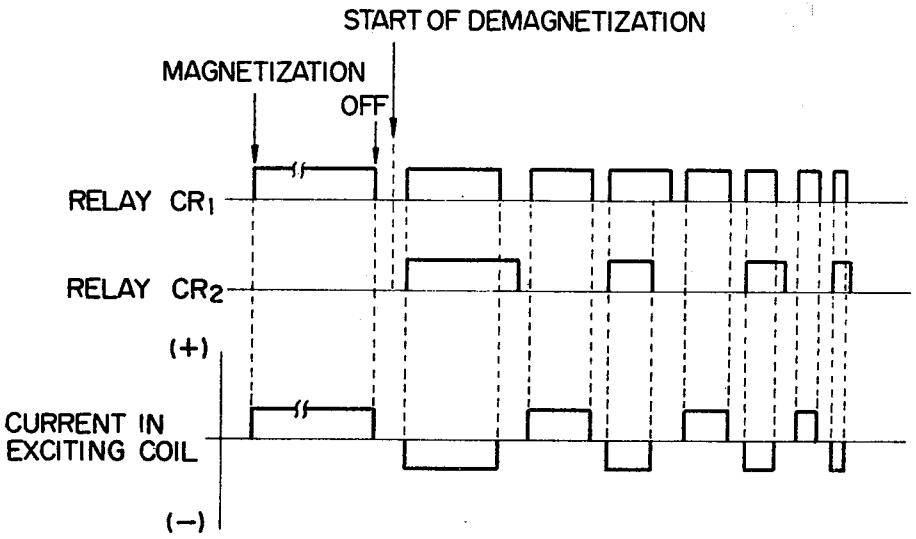
FIG. 3 is a time chart showing an excited state of relays and an exciting coil shown in FIG. 2.

The operations of the relays $CR_1$,$CR_2$ are controlled sequentially along the demagnetization pattern stored in said memory circuit and selected by said DIP switches DS as, for example, as shown in FIG. 3. Current having a constant value and polarity changed over and change-over cycle gradually decreased is supplied to the exciting coil 16 so that the residual magnetism in said chuck is completely erased. After the completion of said demagnetization pattern said apparatus 10 is placed in the quiescent condition by "1" signal from the data bus $D_4$ in said memory circuit 18.

Next, are exemplified on Tables 1 and 2 the data for different demagnetization patterns to be stored in the memory circuit 18.

TABLE 1

| Data No. 1 | | |
|---|---|---|
| Address | Data | Comment |
| FF | FF | Quiescence: demagnetized after positive excitation and then a certain quiescent time to prevent arc and the like. |
| FE | F4 | |
| FD | 3F | $CR_1$ relay ON (reverse excitation) |
| FC | 3F | |
| FB | 3F | $CR_2$ |
| FA | 3D | |
| F9 | BF | OFF ($CR_1$ relay OFF, $CR_2$ relay ON) |
| F8 | B4 | |
| F7 | FF | Polarity change-over ($CR_1$ relay OFF, $CR_2$ relay OFF) |
| F6 | F4 | |
| F5 | 7F | $CR_1$ relay On (positive excitation) |
| F4 | 7F | |
| F3 | 7F | |
| F2 | 74 | |
| F1 | FF | OFF |
| F0 | F4 | |
| EF | 3F | |
| EE | 3F | (hereinafter repetition) |
| ED | 3C | |
| EC | BF | |
| EB | B4 | ↓ |
| EA | FF | ↓ |
| E9 | F4 | ↓ |
| E8 | 76 | ↓ |
| E7 | FF | ↓ |
| E6 | F4 | |
| E5 | 35 | |
| E4 | BF | |
| E3 | B4 | |
| E2 | FF | |
| E1 | F4 | |
| E0 | 74 | |
| DF | FF | |
| DE | F4 | |
| DD | 33 | |

TABLE 1-continued

| Data No. 1 | | |
|---|---|---|
| Address | Data | Comment |
| DC | BF | |
| DB | B4 | |
| DA | FF | |
| D9 | F4 | |
| D8 | 72 | |
| D7 | FF | |
| D6 | F4 | |
| D5 | 31 | |
| D4 | BF | |
| D4 | BF | |
| D3 | B4 | |
| D2 | FF | |
| D1 | F4 | |
| D0 | FF | |
| CF | F4 | |
| CE | EF | Completion of demagnetization (data bus ($D_4$ = D) |

TABLE 2

| Data No. 2 (Comment omitted) | | | | | |
|---|---|---|---|---|---|
| Address | data | Address | data | Address | data |
| 7F | FF | 67 | 7F | 4F | 72 |
| 7E | F4 | 66 | FF | 4E | FF |
| 7D | 3F | 65 | F4 | 4D | F4 |
| 7C | 3F | 64 | 3F | 4C | 31 |
| 7B | 3F | 63 | BF | 4B | BF |
| 7A | 3D | 62 | B4 | 4A | B4 |
| 79 | BF | 61 | FF | 49 | FF |
| 78 | B4 | 60 | F4 | 48 | F4 |
| 77 | FF | 5F | 76 | 47 | FF |
| 76 | F4 | 5E | FF | 46 | F4 |
| 75 | 7F | 5D | F4 | 45 | EF |
| 74 | 7F | 5C | 35 | (completion) | |
| 73 | 7F | 5B | BF | | |
| 72 | 74 | 5A | B4 | | |
| 71 | FF | 59 | FF | | |
| 70 | F4 | 58 | F4 | | |
| 6F | 3F | 57 | 74 | | |
| 6E | 3F | 56 | FF | | |
| 6D | 3C | 55 | F4 | | |
| 6C | BF | 54 | 33 | | |
| 6B | B4 | 53 | BF | | |
| 6A | FF | 52 | B4 | | |
| 69 | F4 | 51 | FF | | |
| 68 | 7F | 50 | F4 | | |
| (continued to address 67) | | (continued to address 4F) | | | |

The addresses and data on said respective tables are indicated in sexadecimal notation, and for example the address FF corresponds to (1111,1111) and the data FF corresponds to (1111,1111) of the output of the data buses $D_7$–$D_4$, $D_3$–$D_0$. Thus, for example, according to the data FF,F4 of the address FF,FE on Table 1, the quiescent condition is specified by value "F" of the respective upper 4 bits, and this quiescent condition is kept for the lower 4 bits, i.e. sum of the respective value of the data buses $D_3$–$D_0$ i.e. 20T seconds (T is said oscillation cycle of clock pulse). Also, succeeding reverse excitation condition is specified by "3" of values of the respective upper 4 bits of the data 3F,3F,3F,3D, i.e. the data buses $D_7$–$D_4$ (0011) and is kept for the sum of values of the respective lower 4 bits, i.e. 61T seconds.

Accordingly, to perform the demagnetization patterns according to Table 1 stored in the memory circuit 18, the control switch 36 is operated to the demagnetization position after both DIP switches DS of the initial address selecting means 22 are opened to assign the initial address (F,F), i.e. (1111,1111) to the address setting circuit 20. In order to perform the demagnetization pattern according to Table 2, only one DIP switch DS will do which corresponds to D input terminal of the up-down counter J and is closed to assign the initial address (7,F), i.e. (0111,1111) to the address setting circuit 20.

According to the present invention, the optimum demagnetization pattern among a plurality of demagnetization patterns can be selected only by the operation of DIP switches DS. Since the control of relay for changing over current supplied to the exciting coil is carried out electrically on the basis of information in memory circuit, the selected demagnetization pattern does not have any dispersion. Inasmuch as the polarity can be changed over in high speed, uniform and very satisfactory demagnetization effect can be obtained. Further, since the pulse oscillation cycle of the clock pulse generating circuit can be varied, the demagnetizating time can be increased and decreased with respect one selected demagnetization pattern to thereby provide the optimum demagnetization effect.

Thus, the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A demagnetizing power source for supplying direct current from a rectifying circuit to a exciting coil which current has its polarity changed over alternatively by a polarity changing-over circuit and its change-over cycle gradually decreased to produce an attenuation alternating field for demagnetization in said exciting coil, comprising a memory circuit for storing a plurality of demagnetization patterns and sending actuating signals to said polarity changing-over circuit, an address setting circuit for sending address assigning signals assigned by a initial address selecting means for selecting said demagnetization pattern according to demagnetization starting signals to said memory circuit, a clock pulse generating circuit, a counter circuit for receiving clock pulses from said clock pulse generating circuit and time assigning signals from said memory circuit assigned by address assigning signals of said address setting circuit to produce ripple carry when the number of said clock pulses reach a predetermined value specified by the time assigning signal and an address changing signal generating circuit for receiving said ripple carry and sending the address changing signals respectively to said address setting circuit and said counter circuit to advance the output address assigning signal sent from said address setting circuit to said memory circuit towards sequentially succeeding address assigning signals according to the selected demagnetization pattern and apply the succeeding time assigning signals produced from said memory circuit to the input of said counter circuit, whereby the quiescent condition is set by quiescent signals sent from said memory circuit to said address setting circuit after performing one selected demagnetization pattern.

2. A demagnetizing power source as set forth in claim 1, wherein said memory circuit has a plurality of address buses receiving address signals from said address setting circuit and a plurality of data buses putting out the information corresponding to said address signals, said information including the driving signal for said polarity changing-over circuit and the time assigning signal for said counter circuit.

3. A demagnetizing power source as set forth in claim 1, wherein said address setting circuit has a plurality of input terminals to which said initial address selecting means is connected.

4. A demagnetizing power source as set forth in claim 1, wherein said address setting circuit has a pair of up-down counters which are connected in series with each other and said initial address setting means is connected to the input terminals of one of said up-down counters.

5. A demagnetizing power source as set forth in claim 1, wherein said clock pulse generating circuit has a multiple vibrator provided with a variable resistor for adjusting the oscilation cycle of the clock pulse.

6. A demagnetizing power source as set forth in claim 1, further including an initiation setting circuit for setting the whole unit, a control switch, and a signal generating circuit sending a signal to said address setting circuit and said memory circuit upon receiving a signal from said initiation setting circuit and a signal from said control switch, said address setting circuit putting out the address signal assigned by said initial address selecting means and said memory circuit putting out the information corresponding to the address signal.

7. A demagnetizing power source as set forth in claim 6, further including a positive exitation signal generating circuit sending a quiescent signal to said signal generating circuit upon receiving a positive excitation signal from said control switch, whereby said polarity changing-over circuit is kept in a quiescent condition and a constant direct current is supplied to said coil to produce a constant magnetic field for holding a magnetic substance.

* * * * *